United States Patent [19]

Brandis et al.

[11] 4,242,130

[45] Dec. 30, 1980

[54] HIGH-SPEED STEEL

[75] Inventors: Helmut Brandis, Krefeld; Hans H. Weigand, Tönisvorst; Wolfgang Spyra, Krefeld, all of Fed. Rep. of Germany

[73] Assignee: Thyssen Edelstahlwerke AG, Krefeld, Fed. Rep. of Germany

[21] Appl. No.: 973,686

[22] Filed: Dec. 27, 1978

[30] Foreign Application Priority Data

Dec. 27, 1977 [DE] Fed. Rep. of Germany ..... 2758330

[51] Int. Cl.[3] ..... C22C 38/22

[52] U.S. Cl. ..... 75/126 C; 75/126 E; 75/126 F; 75/126 H; 75/126 P

[58] Field of Search ..... 75/126 R, 126 A, 126 E, 75/126 F, 126 C, 126 H, 126 J, 126 P, 134 F, 244

[56] References Cited

U.S. PATENT DOCUMENTS

| | | | |
|---|---|---|---|
| 2,099,509 | 11/1937 | Blessing | 75/126 H |
| 2,147,122 | 2/1939 | Emmons | 75/126 H |
| 3,627,514 | 12/1971 | Steven | 75/126 E |
| 3,809,541 | 5/1974 | Steven | 75/244 |
| 3,850,621 | 11/1974 | Haberling et al. | 75/126 C |
| 4,021,205 | 5/1977 | Matsuda et al. | 75/126 C |
| 4,032,302 | 6/1977 | Nakamura et al. | 75/126 C |
| 4,080,205 | 3/1978 | Niimi et al. | 75/126 C |
| 4,121,929 | 10/1978 | Kawai et al. | 75/123 B |

*Primary Examiner*—L. DeWayne Rutledge
*Assistant Examiner*—Peter K. Skiff
*Attorney, Agent, or Firm*—Kenyon & Kenyon

[57] ABSTRACT

Disclosed herein is a highly wear-resistant, corrosion-resistant steel having high thermal resistance and tempering stability which consists of Fe; 0.7–1.7%C; 0.01–0.08%N; 0.02–1.5%B; 0.01–1.5% Si; 0.01–1.0% Mn; 5.0–15.0% Co; 3.0–7.0% Cr; 13.0–20.0% Mo; 0.02–2.0% Nb and/or Ta. The steel may additionally contain up to 10.0% W and up to 5.0% V.

2 Claims, 8 Drawing Figures

HARDNESS AS A FUNCTION OF THE TEMPERING TEMPERATURE

MATERIALS AND HEAT TREATMENT:

1) CORRESPONDING TO S 0-18-1-12 ACCORDING TO THE INVENTION. HARD FACED AND TEMPERED 3X1 HOUR

2) CORRESPONDING TO S 10-4-3-10, 1230 °C 205 SEC/OIL AND TEMPERED 3X2 HOURS (FOR COMPARISON)

PARTICLES OF THE INTERMETALLIC PHASE $Fe_3Mo_2$ FORMED DURING SOLIDIFICATION OF THE MELT

MATERIAL: CORRESPONDING TO S 0-20-1-15 (ACCORDING TO THE INVENTION, LIMIT CASE)

CONDITION: CAST

V = 100 : 1

$Fe_3Mo_2$ →

V = 500 : 1

ETCHING AGENT: MIXED ACID

DEPENDENCE OF THE HARDNESS AFTER TEMPERING ON EFFECTIVE CARBON CONTENT

MATERIALS: OF THE INVENTION
CONDITION: TEMPERED 1) 540°C 3×1hr
2) 600°C 3×1hr

EFFECTIVE CARBON CONTENT: $\%C_{eff} = \%C + 0.86 \cdot \%N + 1.11 \cdot \%B$

CAST STRUCTURE OF HIGH-SPEED STEEL WITH AND WITHOUT BORON

BASIC COMPOSITION

| C | Si | Mn | Cr | Mo | V | Co |
|---|---|---|---|---|---|---|
| 1,08 | 1.3 | < 0.02 | 4.5 | 16 | 1.3 | 12 |

WITHOUT B 0.8% B

V = 100 : 1

V = 500 : 1

ETCHING AGENT: MIXED ACID

TEMPERATURE - SERVICE LIFE TURNING TEST FOR TESTING RETENTION OF THE CUTTING EDGE OF HIGH SPEED STEELS WITHOUT BORON AND CONTAINING BORON AND TANTALUM

BASIC COMPOSITION:

| Si | Mn | Cr | Mo | V | Co |
|---|---|---|---|---|---|
| 1.3 | 0.03 | 4 | 18 | 1.3 | 12 |

HEAT TREATMENT: 600° C 3x1 hr.

| EDGE GEOMETRY: | α | γ | ε | κ | λ | r |
|---|---|---|---|---|---|---|
| | 8° | 15° | 90° | 60° | -4° | 1.0mm |

WORK PIECE MATERIAL: 30 CrNiMo8

STRENGTH: 980 N/mm²

CHIP CROSS SECTION: a x s = 2.0 x 0.45 mm²

Fig. 6.

TEMPERATURE-SERVICE LIFE TURNING TEST

TEST TOOLS: HARD-FACED WITH ELECTRODES OF THE COMPOSITION

| DESIGNATION | C | B | N | Si | Mn | P | S | Cr | Mo | V | Co | Ta |
|---|---|---|---|---|---|---|---|---|---|---|---|---|
| EXAMPLE 1 | 1.23 | 0.187 | 0.030 | 1.33 | 0.04 | 0.008 | 0.035 | 3.91 | 18.16 | 1.20 | 11.81 | 0.48 |
| EXAMPLE 2 | 1.33 | 0.222 | 0.031 | 1.33 | 0.04 | 0.014 | 0.033 | 3.91 | 18.12 | 1.25 | 11.77 | 0.48 |
| EXAMPLE 3 | 1.48 | 0.174 | 0.042 | 1.28 | 0.03 | 0.010 | 0.035 | 3.67 | 18.12 | 1.20 | 11.77 | 0.48 |

TREATMENT:

AUTOGENOUS HARD-FACING ON BASE MATERIAL 49 Mn Si Nb 3, TEMPERED 600°C 3x1hr.

COMPARISON TOOLS: S10-4-3-10

HEAT TREATMENT: 1240°C 160 SEC/OIL + 560°C 2x1 hr

ROCKWELL HARDNESS: 66.5 HRC

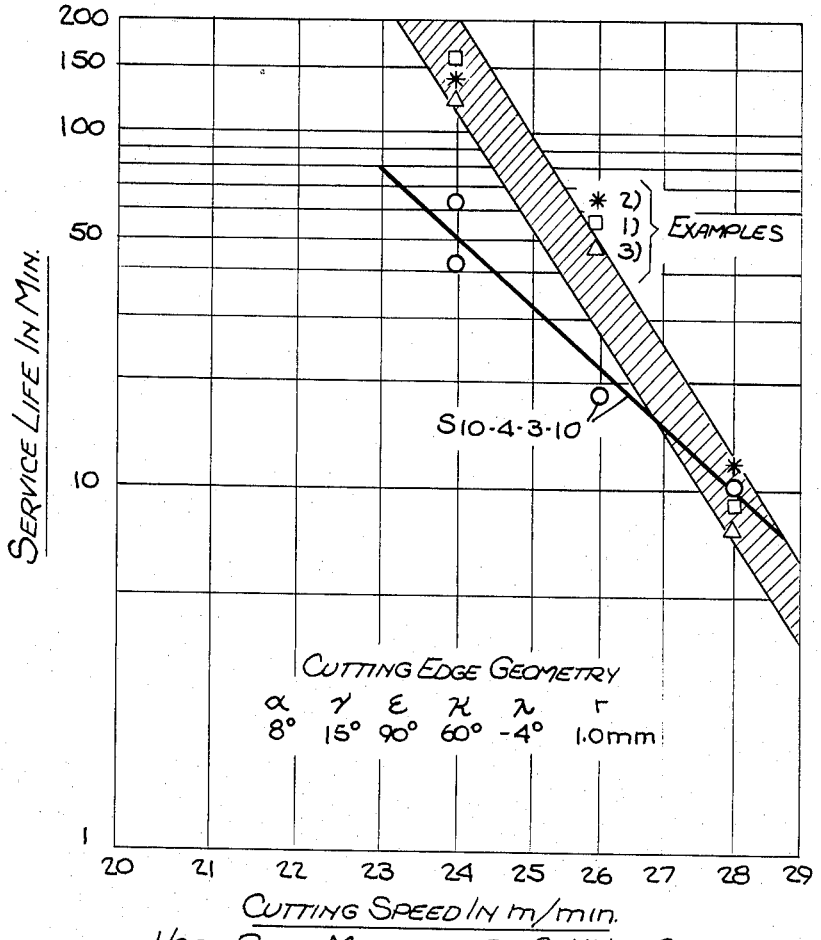

WORK PIECE MATERIAL: 30 CrNiMo 8

STENGTH: 980 N/mm²

CHIP CROSS SECTION: a x s = 2.0 x 0.45 mm²

Fig. 7.

TEMPERATURE - SERVICE LIFE TURNING TEST

TEST TOOL: HARD FACED WITH ELECTRODES OF THE COMPOSITION

| DESIGNATION. | C | B | N | Si | Mn | P | S | Cr | Mo | V | Co | Ta |
|---|---|---|---|---|---|---|---|---|---|---|---|---|
| EXAMPLE 4. | 1.17 | 0.270 | 0.034 | 1.21 | 0.22 | 0.008 | 0.012 | 5.12 | 17.94 | 1.29 | 11.84 | 0.38 |

TREATMENT:

AUTOGENOUS HARD-FACING ON BASE MATERIAL 49 MnSiNb3, TEMPERED 600°C 3x1 hr.

COMPARISON TOOL: S 10-4-3-10

HEAT TREATMENT: 1240°C 160 SEC/OIL + 560°C 2x1 hr.

ROCKWELL HARDNESS 66.5 HRC

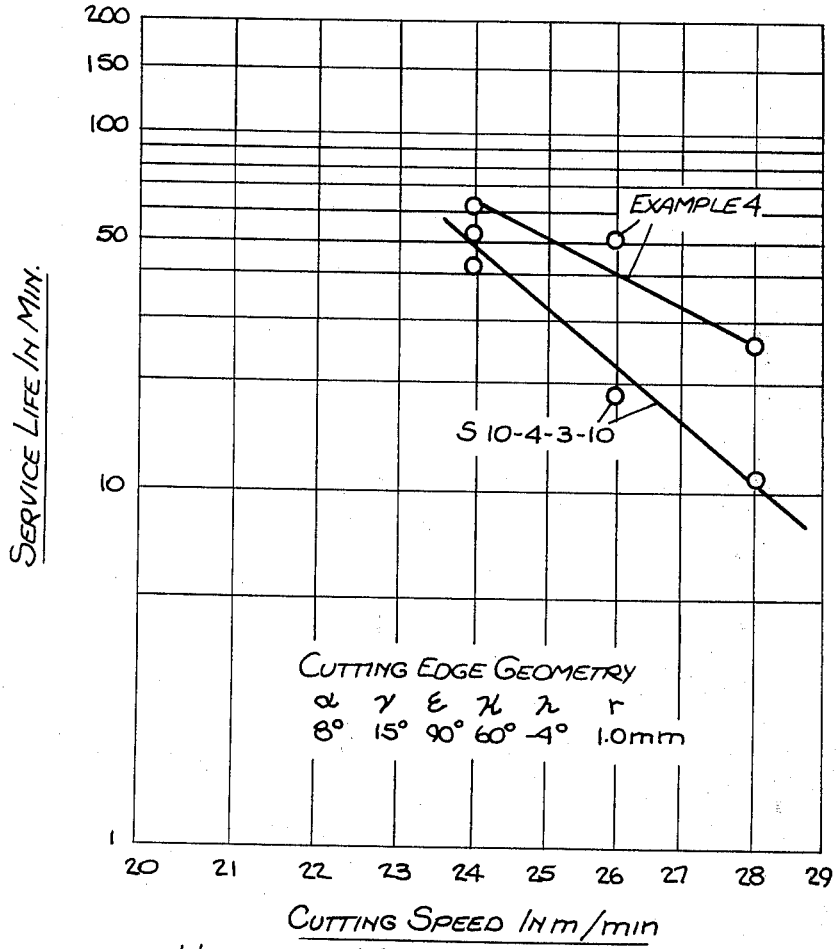

WORKPIECE MATERIAL: 30 CrNiMo 8

STRENGTH: 980 N/mm²

CHIP CROSS SECTION: a x s = 2.0 x 0.45 mm²

Fig. 8.

TEMPERATURE - SERVICE LIFE TURNING TEST AS A FUNCTION OF THE TEMPERING TEMPERATURE AND HARDNESS

TEST TOOL: HARD FACED WITH ELECTRODES OF THE COMPOSITION

| DESIGNATION. | %C | %B | %N | %Si | %Mn | %P | %S | %Cr | %Mo | %V | %Co | %Ta |
|---|---|---|---|---|---|---|---|---|---|---|---|---|
| EXAMPLE 5 | 1.18 | 0.191 | 0.049 | 0.57 | 0.14 | <0.005 | 0.006 | 6.04 | 18.08 | 1.41 | 12.91 | 0.56 |

TREATMENT:

AUTOGENOUS HARD-FACING ON BASE MATERIAL 49 MnNb S 3, NOT TEMPERED AND TEMPERED x°C 3 x 1 hr.

COMPARISON TOOL: S10-4-3-10

HEAT TREATMENT: 1240°C 160 SEC/OIL + 550°C 2x1 hr

ROCKWELL HARDNESS: 66.5 HRC

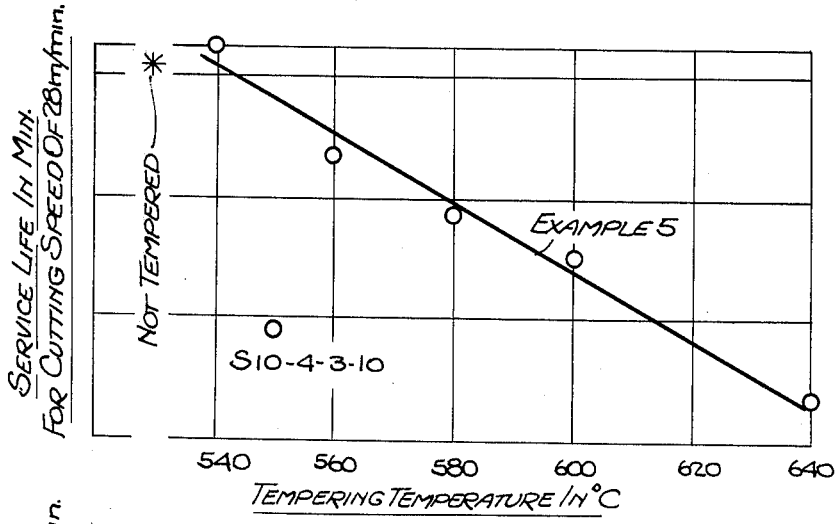

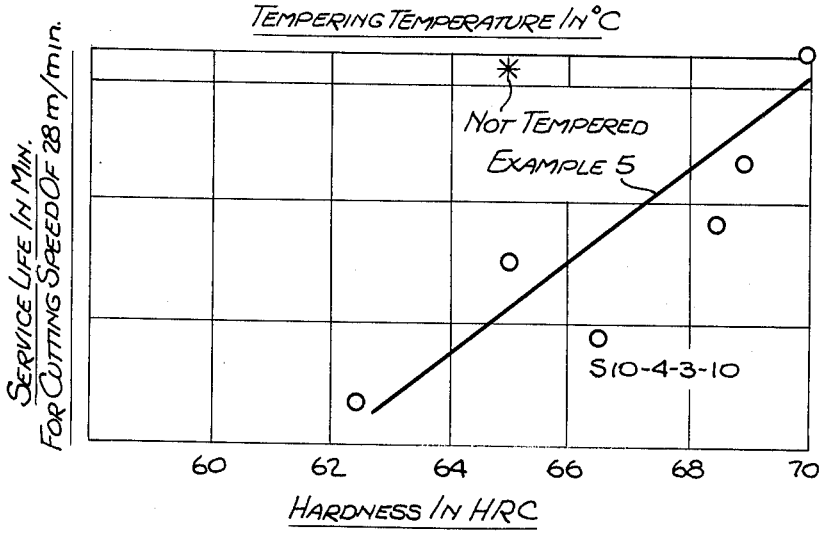

WORKPIECE MATERIAL: 30 CrNiMo8

STRENGTH: 980 N/mm²

CHIP CROSS-SECTION: a x s = 2.0 x 0.45 mm

HIGH-SPEED STEEL

The invention relates to a highly wear-resistant high-speed steel with great thermal resistance and tempering stability for cold and hot working tools as well as parts subject to wear.

BACKGROUND OF THE INVENTION

According to AISI Material Standards as well as to Stahl-Eisen-Werkstoffblatt (Steel-Iron Material Bulletin), the commercially available high-speed steels are in the following alloy range:

| | | | |
|---|---|---|---|
| 0.5 | to | 3.0% | C |
| 0 | to | 12.0% | Co |
| 3.0 | to | 5.0% | Cr |
| 0.5 | to | 12.0% | Mo |
| 1 | to | 10.0% | V |
| 1 | to | 19.0% | W |
| Remainder Fe. | | | |

They are predominantly melted in an arc furnace and are further processed by forging, rolling and drawing. The output decreases steeply with increasing alloy content. As a result, tempered high-speed steels have not appreciably more than 30% by volume of carbide. If the processing leads via semifinished material, the alloy content is limited by the hot workability. This is not true to the same extent for fabrication processes, in which parts are made directly, such as sintering as well as pressure sintering and casting as well as cladding by hard-facing, spraying or immersion. The reference to the last-mentioned special processes indicates savings of alloying elements can be achieved by composite action of different materials. According to general opinion, a base material of unalloyed or alloyed structural steel with a strength of 800 $N/mm^2$ is sufficient. In the investigations pertaining to the following application, micro-alloyed perlitic steel such as Material 49 MnSiNb 3 with a hardness of about 248 HV 10 has proven itself as base material.

High-speed steels are distinguished by high tempering stability and hot hardness as well as high wear resistance. In the average, the chromium content of high-speed steels is 4%. In a ferrite-free, low residual austenite, martensitic structure, this chromium content in conjunction with carbon ensures sufficient hardness and toughness. The hot hardness is increased by finely distributed precipitates of special carbides of the elements tungsten, molybdenum and vanadium taking place in the solid solution. The carbides formed during the solidification of the melt and in the solid state, embedded in the martensitic base matrix provide the high wear resistance. A particularly pronounced influence on the wear characteristics is ascribed to the relatively hard vanadium carbides.

SUMMARY OF THE INVENTION

It is an object of the invention to extend the service life of tools of high-speed steels, especially if used hot, by increasing the tempering resistance. In addition, a simplification in grinding the tools of high-speed steel is desired, while at the same time the wear resistance of the tools is improved. Finally, the cost of manufacturing the steel is to be reduced by an appropriate choice of raw materials, i.e., the use of the most inexpensive alloying elements possible.

According to the invention, a highly wear-resistant steel with high thermal stability and temperating resistance is proposed for cold and hot working tools as well as for parts subject to wear, with the composition according to claim 1, to solve this problem.

Preferred is a steel with the composition given in claim 2.

The steel according to the invention is particularly well suited for the fabrication of semifinished materials and parts by casting processes including continuous casting, as well as by powder-metallurgical processes including pressure sintering, with the possibility of adding hard materials such as $Fe_3MO_2$, CoMo, $Fe_3W_2$, CoW, TiC, WC, TaC, TiN, to the starting powder.

According to the invention, also the cladding of parts of structural steel and tool steel with the steel according to the invention is provided. Cladding which serves as wear protection is usually not subjected to a heat treatment. If, however, depending on the application, certain hardness and toughness combinations are desired, then the steel according to the invention can be heat-treated. A preferred heat treatment consists of annealing once or several times in the temperature range between 500° and 830° C.

Although it is known that in high-speed steels part of the tungsten can be replaced by molybdenum, the tungsten-free high-speed steels according to the invention are unusual. It has been found that a complete replacement of tungsten by molybdenum, if good hot workability is sacrificed and casting, welding and sintering processes are preferred, brings the addition of valuable properties. Obvious advantages of the replacement are: Lowering of the specific gravity of the alloy for constant atom percent content as well as comparatively lower raw material costs even for the same mass percent content, i.e., for approximately twice the atom percent content.

The machining of the high-speed steel, hardened as well as in the cast or sintered condition, for instance, by grinding, is facilitated substantially if, in addition to replacing tungsten by molybdenum in the sintered carbide $M_6C$, also the relatively hard vanadium carbide MC is replaced by molybdenum carbide of the $M_6C$ and $M_2C$ types. Because of its great hardness, vanadium carbide exhibits high wear resistance against the usual abrasives. In Table 1, hardness values of hard substances in abrasives are juxtaposed to those of carbides in high-speed steel.

In using the high-speed steel for cutting, no substantial loss of the wear characteristics was expected even though the special carbides were limited to molybdenum carbides, if the hardness of the molybdenum carbides and the martensitic steel matrix in the tool exceeds the hardness of the structure components in the work piece. Since such an assumption is frequently fulfilled in the application, it was further assumed that to a higher degree the quantity and distribution rather than the kind of the special carbides are responsible for the preservation of the cutting edge, next to the thermal stability of the steel matrix, as long as structure breakup and reactions of the tool with the work piece material do not become dominant influence factors. In consideration of this notion, provision was made to introduce the greatest possible amount of finely distributed molybdenum carbides into the high-speed steel. Vanadium as an alloying element was retained in an amount which, as far as possible, does not lead to the separate formation of vanadium carbide.

Materials and heat treatment:

(1) corresponding to S 0-18-1-12, according to the invention, hard-faced+tempered 3×1 hour (according to claim)

(2) corresponding to S 10-4-3-10, 1230° C. 205 sec/oil+tempered 3×2 hours (for comparison)

(a) Hardness in HRO (b) Tempering temperature in °C.

Figure 2:
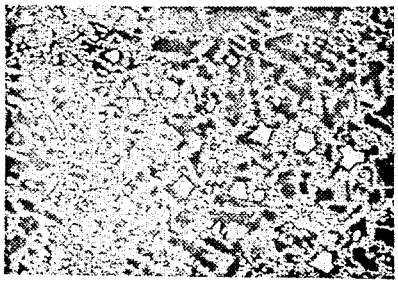
Figure 2:
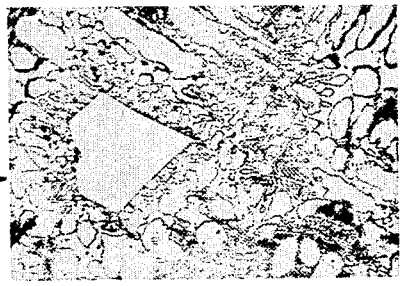
Figure 3:
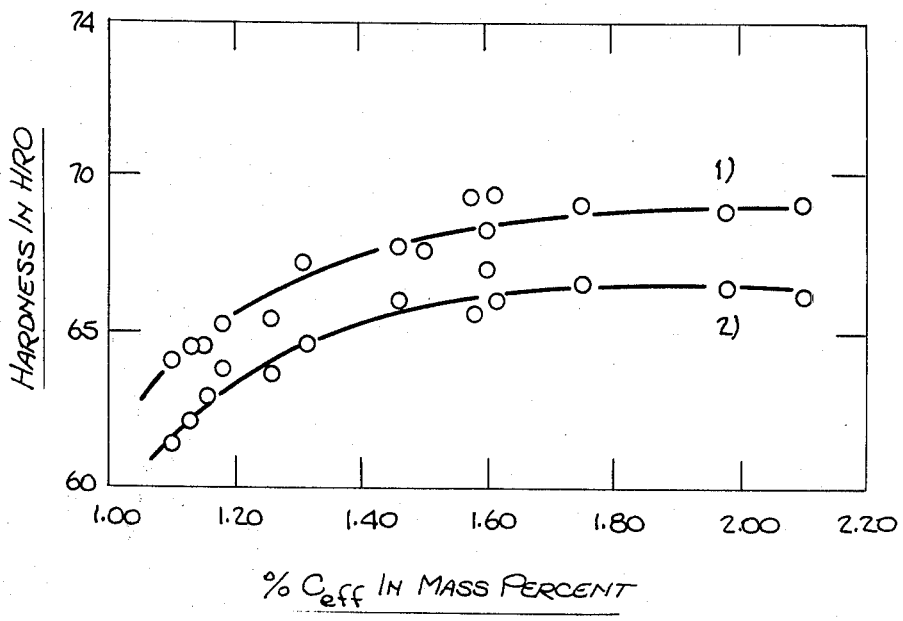

FIG. 2. Particles of the intermetallic phase $Fe_3MO_2$ formed during the solidification of the melt Material: corresponding to D 0-20-1-15 (according to the invention, limit case); condition: cast (a) Etching agent: mixed acid FIG. 3. Dependence of the hardness after the tempering on the effective carbon content Materials: as per claims 1 and 2

Condition: tempered, (1) 540° C., 3×1 hr; (2) at 600° C., 3×1 hr (a) effective carbon content (b) Hardness in HRO (c) mass pct.

Figure 4:
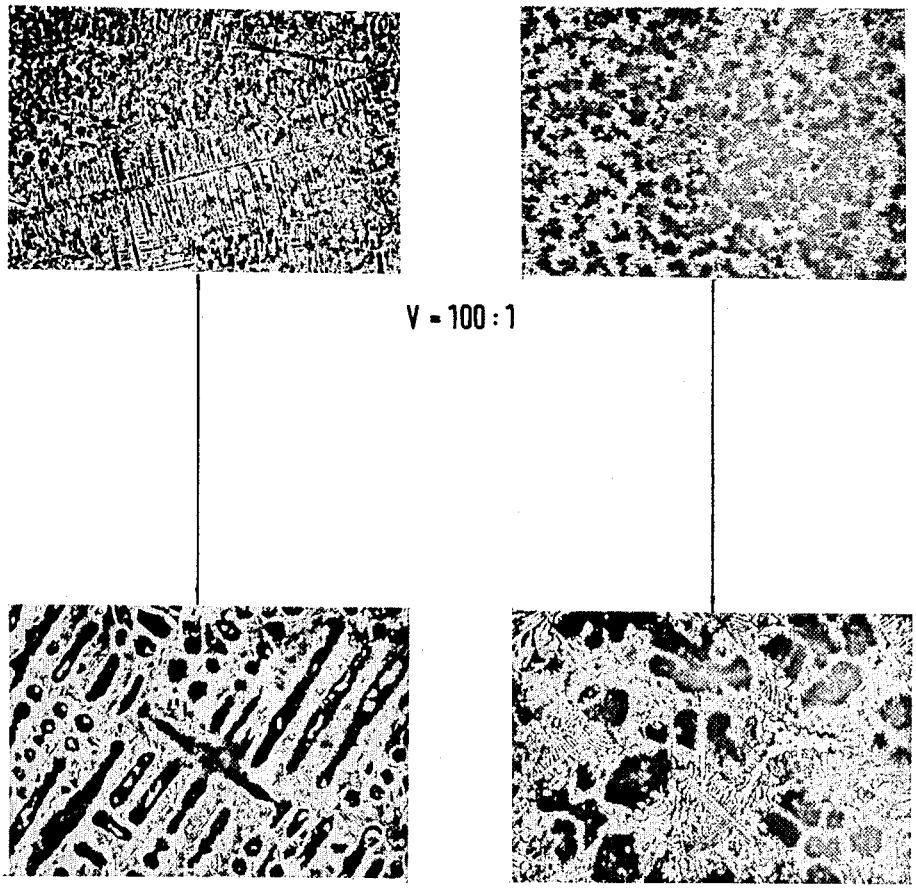

FIG. 4. Cast structure of high-speed steel with and without boron

Basic composition (a) Etching agent: mixed acid

Figure 5:
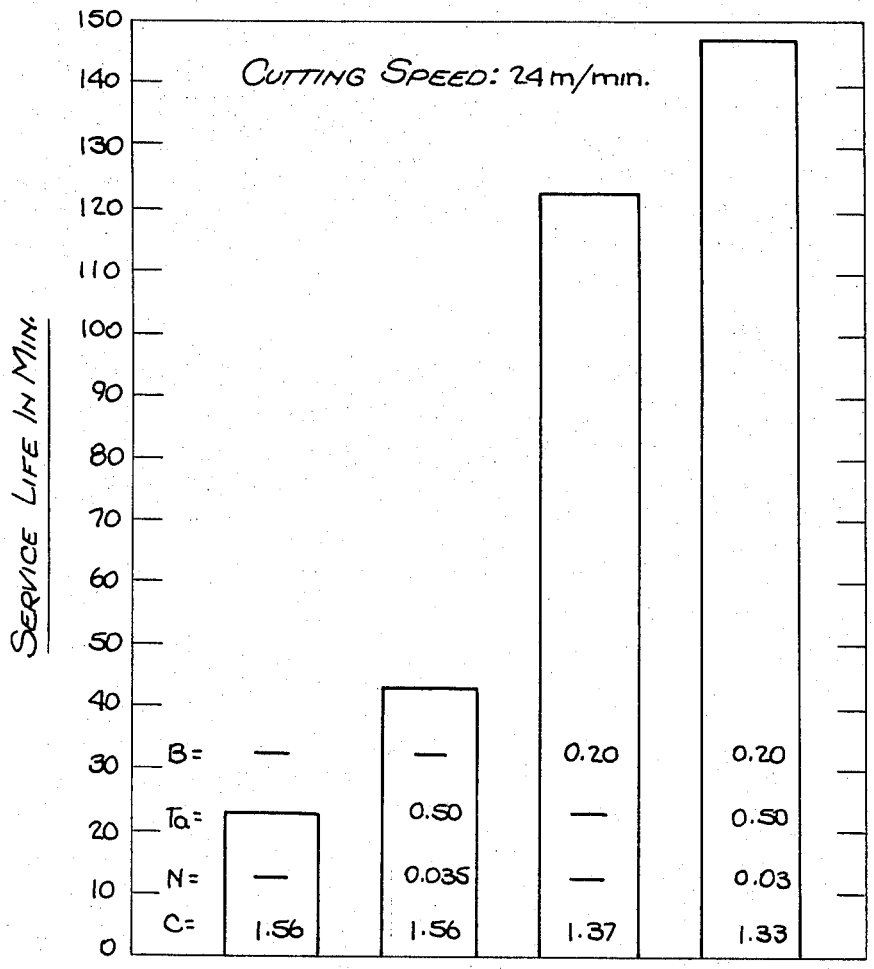

FIG. 5. Temperature-service life turning test for testing retention of the cutting edge of high-speed steels without boron and containing boron as well as tantalum Basic composition:

Heat treatment:

(a) Cutting speed (b) Service life in min (c) Edge geometry:

(d) Work piece material (e) Strength (f) chip cross section

FIG. 6. Temperature-service life turning test

Test tools: Hard-faced with electrodes of the composition:

(a) Designation (b) Example

Treatment:

Autogenous hard-facing on base material 49 MnSiNb 3 tempered 600° C., 3×1 hr

Comparison tool: S 10-4-3-10

Heat treatment: 1240° C., 160 sec/oil+560° C. 2×1 h

Rockwell hardness: 66.5 HRC (c) Service life in min (d) cutting speed in m/min (e) Work piece material (f) Strength (g) chip cross section (h) Cutting edge geometry FIG. 7. Temperature-service life turning test Test tool: hard-faced with electrodes of the composition: other legends, see FIG. 6

FIG. 8. Temperature-service life turning test as a function of the tempering temperature and the hardness Test tool hard-faced with electrodes of the composition:

(a) Designation (b) Example

Treatment: autogenous hard-facing on base material 49 MnNbS 3 not tempered and tempered Comparison tool: S 10-4-3-10

Heat treatment: 1240° C., 160 sec/oil +550° C. 2×1 h

Rockwell hardness: 66.5 HRC (c) Service life in min, for cutting speed 28 m/min (d) Tempering temperature in °C (e) Hardness in HRC (f) Work piece material Strength Chip cross section (g) not tempered.

DETAILED DESCRIPTION OF THE DRAWINGS

Figure 1:
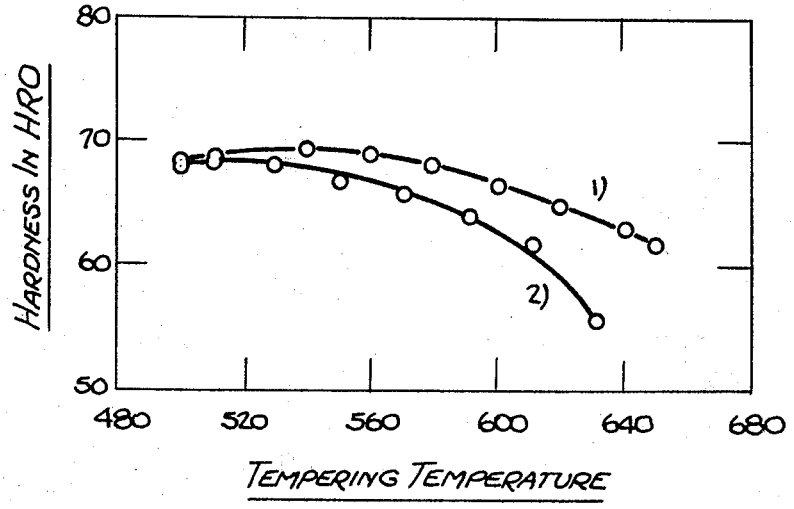
FIG. 1. Hardness as a function of the tempering temperature

In high-speed steels with molybdenum contents from about 13% up, there occurs, in addition to the carbide precipitation, also precipitation of an intermetallic phase of the $Fe_3Mo_2$ type during the tempering in the temperature range of 500° to 700° C. The maximum hardness values obtainable with changed tempering temperatures are around 550° C. for the special carbides and at 600° C. for the intermetallic phase. By superimposing the precipitation hardening via special carbides and the intermetallic phase and by shifting the position of the corresponding hardness maxima as to the tempering temperature, substantially improved tempering stability was achieved over conventional high-speed steels; Steel S 10-4-3-10 was used for comparison (FIG. 1), which also has effects on the temperature-service life behavior. The molybdenum content, which should be made as high as possible in order to increase the tempering stability, is limited, in the steels investigated in the cast condition, by the intermetallic phase $Fe_3Mo_2$ (FIG. 2), which precipitates when Mo is present in amounts greater than 20% during the solidification of the melt in coarse platelets and causes in this form heavy embrittlement of the material. Alloying additions of cobalt to avoid the formation of ferrite and to increase the tempering stability of the martensite enhance the tendency to form the intermetallic phase and were therefore limited to 15% Co.

The silicon content must be adapted to the manufacturing process. Up to a content of 1.5%, silicon improves the flow and wetting behavior of the melt and the oxide formation on the material to be welded without affecting the tempering stability adversely, but makes the sintering activity of unencapsulated blanks of pressed powder worse, similar to manganese and vanadium.

A low sulfur content is essential for good toughness properties, especially in the case of cast structures. The carbon required for the hardness development was unexpectedly found to be partially replaceable by boron. With such replacement, the hardness became higher by about 4.5 HRC, independently of the tempering temperature, through the addition of 1% boron. Boron contents above 1.5% have a highly embrittling effect and were therefore avoided. So as not to affect the hardening due to carbide precipitation during the tempering, a carbon content was necessary which reached at least one-half the value of the stoichiometric carbon content, considering the carbide-forming alloying elements in the steel. The stoichiometric carbon content is given by the following relation:

$$\% C_{st} = 0.06 \times \% \text{ Cr} + 0.206 \times \% \text{ V} + 0.063 \times \% \text{ Mo} + 0.129 \times \% \text{ Nb} + 0.066 \times \% \text{ Ta}.$$

The contents of the partially interchangeable elements carbon, boron and also nitrogen can be combined into an effective carbon content as follows:

$$\% C_{eff} = \% \text{ C} + 0.86 \times \% \text{ N} + 1.11 \times \% \text{ B}.$$

For the highest possible hardness development in tempering, an effective carbon content of more than 1.3% and preferably more than 1.4% is necessary. The ratio of effective to stoichiometric carbon content should not substantially exceed a value of 1.1 for reasons of toughness.

The addition of boron makes the carbide eutectic in the cast structure coarser and shortens the length of the dendrites (FIG. 4). Therefore, the favorable service life behavior of the boron-containing steel, in comparison with steel without boron (FIG. 5), as determined in temperature-service life turning tests, was unexpected. As the service time was counted the cutting time from the start of the test until "Blankbremsung" (bright braking) set in. A further improvement of the service life behavior was obtained by small additions of tantalum or niobium and nitrogen (FIG. 5). The tempering stability, which increases with the molybdenum content, influences particularly the service life at relatively high cutting speeds.

For the examples 1, 2 and 3 of the steel matched as far as alloying contents are concerned, as shown in FIG. 6, the service life T is given as a function of the cutting speed v by the relation $$v \times T^{0.057} = 31.9;\ T \text{ in minutes, } v \text{ in m/min.}$$

The T-v curve of the comparison steel S 10-4-3-10, Material No. 3207.0, on the other hand, is described by the equation $v \times T^{0.099} = 35.5$; T in minutes, v in m/min. The corresponding shape of the service life curves in FIG. 6 demonstrates the superiority of the steel proposed over the commercially available steel; the $v_{60}$ exhaustion number (cutting speed for a 60 minute service life) for turning the work piece of 30 CrNiMo 8 is by comparison about 1.5 m/min higher than for the conventional tool of S 10.4.3.10.

Example 4 shows in FIG. 7 a variant of the described steel with relatively little dependence of the service life on the cutting speed. The T-$v$ curve follows the equation $$v \times T^{0.175} = 49.9;\ T \text{ in minutes, } v \text{ in m/min.}$$

As to the heat treatment of the proposed steel, it should be noted that soft-annealing and hardening treatments are generally unnecessary. A tempering anneal in the temperature range of precipitation hardening already brings about the desired hardness development above the hardness in the cast or welded condition of about 60 to 65 HRC. The example 5 of the steel according to the invention is concerned with the relationship between the tempering temperature, hardness and service life for continuous cutting. It is seen from FIG. 8 that hardness and service life drop with increasing tempering temperatures above 540° C. The longest service life can be associated with the greatest hardness after tempering at 540° C. Unexpectedly, a comparably long service life was reached only by that not tempered sample which was subjected to a self-tempering effect during the test due to the heating-up of the cutting edge. It would seem that the hot hardness, which decreases with progressive tempering, is responsible for the service life.

Autogenous hard-facing of the high-speed steel with a high molybdenum content causes an increase of the carbon content by about 0.1%.

Physical properties such as density and thermal coefficient of expansion were determined for the steel variants of Examples 1 to 4 in the cast condition and for the comparison steel S 10-4-3-10 in the annealed condition. Characteristic values obtained are listed in Table 2. In spite of its high alloy content, the steel with the high molybdenum content exhibits less density than the comparison steel. As to thermal expansion, on the other hand, the comparison steel has the smaller coefficient of expansion. Upon heating, the austenite conversion of the steels mentioned takes place between 800° and 900° C.

In comparison, the start of the allotropic $\alpha/\gamma$-conversion of the steel with the high molybdenum content is shifted to temperatures 30° to 40° C. higher. Far more important because of its order of magnitude of 100° C. is the difference in the solidus and liquidus temperatures between the high-molybdenum steel and the comparison steel. The relatively low solidus temperature of about 1100° to 1150° C. benefits particularly the casting and cladding, but precludes hardening treatment in the usual sense. It was already mentioned that a tempering treatment is sufficient to adjust the required hardness values.

Tests of the rust resistance were made with steel example 4 (composition see FIG. 7). Cast samples showed no rust formation in distilled water at 60° C.

TABLE 1

Comparison of Vickers Hardness of Hard Substances

| Hard Substances in Abrasives | Vickers Hardness | Carbides in the High-Speed Steel | Vickers Hardness |
|---|---|---|---|
| Corundum | 1800 | $M_6C$ (Mo Carbide) | 1100 |
| Silicon Carbide | 2600 | $M_2C$ (Mo Carbide) | 1500 |
| | | MC (V Carbide) | 2800 |

TABLE 1

Physical Properties

| Condition | Steel Example 1 Cast | Steel Example 2 Cast | Steel Example 3 Cast | Steel Example 4 Cast | Comparison Steel S 10-4-3-10 Soft Annealed |
|---|---|---|---|---|---|
| Density $g \cdot cm^{-3}$ | 8,04 | 8,07 | 8,05 | 8,09 | 8,25 |
| Thermal Expansion Coefficient $10^{-6}$ °C.$^{-1}$ | | | | | |
| for 20–100° C. | 12,1 | 12,9 | 12,7 | 12,0 | 10,5 |
| 20–200° C. | 13,0 | 13,9 | 13,7 | 13,2 | 11,7 |
| 20–300° C. | 13,8 | 14,6 | 14,4 | 13,7 | 11,8 |
| 20–400° C. | 14,0 | 14,8 | 14,4 | 14,0 | 12,2 |
| 20–500° C. | 14,2 | 14,9 | 14,5 | 14,2 | 13,2 |
| 20–600° C. | 14,3 | 14,9 | 14,6 | 14,4 | 12,6 |
| 20–700° C. | 14,6 | 15,1 | 15,0 | 14,7 | 12,7 |
| 20–800° C. | 15,2 | 15,6 | 15,0 | 15,6 | 12,6 |
| Conversion Temperatures $Ac_1$ °C. | 841 | 837 | 842 | 836 | 800 |
| $Ac_3$ °C. | 880 | 870 | 870 | 870 | 849 |

TABLE 1-continued

| | Physical Properties | | | | |
|---|---|---|---|---|---|
| Condition | Steel Example 1 Cast | Steel Example 2 Cast | Steel Example 3 Cast | Steel Example 4 Cast | Comparison Steel S 10-4-3-10 Soft Annealed |
| Solidus-Temp. °C. | 1155 | 1110 | 1110 | 1155 | 1240 |
| Liquidus-Temp. °C. | 1320 | 1290 | 1305 | 1315 | 1420 |

We claim:

1. Highly wear-resistant, corrosion-resistant steel with high thermal resistance and tempering stability for cold and hot working tools as well as for parts subject to wear, consisting of:

| | | | |
|---|---|---|---|
| 0.7 | to | 1.7% | C |
| 0.01 | to | 0.08% | N |
| 0.02 | to | 1.5% | B |
| 0.01 | to | 1.5% | Si |
| 0.01 | to | 1.0% | Mn |
| 5.0 | to | 15.0% | Co |
| 3.0 | to | 7.0% | Cr |
| 13.0 | to | 20.0% | Mo |
| 0 | to | 10.0% | W |
| 0 | to | 5.0% | V |
| 0.02 | to | 2.0% | Nb and/or Ta |

-continued

| | | | |
|---|---|---|---|
| Remainder | | | Fe |

2. Steel according to claim 1, characterized by:

| | | | |
|---|---|---|---|
| 0.9 | to | 1.6% | C |
| 0.01 | to | 0.08% | N |
| 0.02 | to | 0.5% | B |
| 0.01 | to | 1.4% | Si |
| 0.01 | to | 0.5% | Mn |
| 10.0 | to | 14.0% | Co |
| 3.0 | to | 7.0% | Cr |
| 15.0 | to | 19.0% | Mo |
| 0.5 | to | 1.5% | V |
| 0.05 | to | 1.0% | Nb and/or Ta |
| Remainder | | | Fe, |

with the provision that the relation $1.3 < C_{eff} < 1.1 \times C_{st} < 2$ is fulfilled.

* * * * *

UNITED STATES PATENT AND TRADEMARK OFFICE

CERTIFICATE OF CORRECTION

PATENT NO. : 4,242,130

DATED : December 30, 1980

INVENTOR(S) : Brandis, et al.

It is certified that error appears in the above—identified patent and that said Letters Patent is hereby corrected as shown below:

Column 2, line 13

$Fe_3MO_2$ should read $Fe_3Mo_2$

Column 3, line 13

$Fe_3MO_2$ should read $Fe_3Mo_2$

Signed and Sealed this

*Nineteenth* Day of *May 1981*

[SEAL]

*Attest:*

RENE D. TEGTMEYER

*Attesting Officer*

*Acting Commissioner of Patents and Trademarks*